United States Patent [19]

Stone

[11] 4,071,200

[45] Jan. 31, 1978

[54] ELECTRIC TOILET TISSUE DISPENSER

[76] Inventor: Barry N. Stone, 662 Rockbridge Road, NW., Lilburn, Ga. 30247

[21] Appl. No.: 699,678

[22] Filed: June 25, 1976

[51] Int. Cl.[2] ..... A47K 10/38

[52] U.S. Cl. ..... 242/55.2

[58] Field of Search ..... 242/55.2, 55.53, 55.3, 242/68.4, 55, 67.1 R, 67.3 R

[56] References Cited

U.S. PATENT DOCUMENTS

| | | | |
|---|---|---|---|
| 1,207,323 | 12/1916 | Pico | 242/55.53 |
| 3,317,150 | 5/1967 | Summersby | 242/55.2 |

FOREIGN PATENT DOCUMENTS

| | | | |
|---|---|---|---|
| 1,111,941 | 11/1955 | France | 242/55.3 |

*Primary Examiner*—George F. Mautz

*Attorney, Agent, or Firm*—Newton, Hopkins & Ormsby

[57] ABSTRACT

A toilet tissue dispensing assembly comprising a housing which can fit over the mounting brackets of an existing wall-mounted toilet tissue dispenser and having two opposed, laterally projecting arms, one of the arms having a driving gear assembly powered by a battery-operated motor contained within that arm and a cylindrical core that is received within a roll of toilet tissue and having a driven gear assembly on one of its ends adapted to engage the driving gear in the arm and having a spring-biased pin adapted to engage an opening in the other arm, whereby actuation of the motor will cause the core to be rotated to dispense a desired amount of tissue.

9 Claims, 3 Drawing Figures

ELECTRIC TOILET TISSUE DISPENSER

BACKGROUND OF THE INVENTION

1. Field of the Invention

This invention relates to a toilet tissue holder and, more particularly, to a battery-operated toilet tissue dispenser.

2. Description of the Prior Art

There have been many devices provided in the past which automatically rotate a roll of toilet tissue about a spool or core in a holder to dispense a selected amount of toilet tissue for the user. Such devices are helpful for handicapped individuals who would normally find the manipulation of a toilet tissue roll to be, at the least, laborious, or beyond their physical means. Also, such appliances are convenient to eliminate the tiresome chore of rewinding the toilet roll after it has been mistakenly pulled too fast.

Previous devices includes structures as illustrated in U.S. Pat. No. 3,892,368, issued to Ricards on July 1, 1975; and U.S. Pat No. 3,473,749, issued to Rogers on Oct. 21, 1969. Summersby, U.S. Pat. No. 3,317,150, issued May 2, 1967, also shows a self-powered dispenser. The disadvantages in those structures is that no means was provided for adapting those devices to a pre-existing toilet tissue dispenser. Also, the motor or drive means for the devices was located within the spool which was susceptible to being damaged when it was being removed from a used toilet tissue roll to be placed within a new roll.

SUMMARY OF THE INVENTION

The above disadvantages are overcome by the present invention which comprises a toilet tissue dispensing assembly having a housing which includes a pair of mounting arms laterally projecting from opposed sides of a frame. The mounting arms are hollow so as to engage the mounting brackets of a pre-existing wall-mounted toilet tissue dispenser. One of the mounting arms has an opening therein and the other arm is provided with a battery-powered drive gear assembly. The other arm has a compartment for batteries which are operatively connected to the motor through an externally operated switch.

A cylindrical core is adapted to frictionally engage the cardboard cylinder that is normally found in a roll of toilet tissue paper. The core is provided at one of its ends with a spring-biased pin and at its other end with a driven gear assembly which is adapted for meshing engagement with the drive gear in the mounting arm. The core is horizontally disposed between the arms by means of the pin engaging the opening in one of the arms and the gear on the core engaging the drive gear on the arm.

One embodiment of the driving and driven gear assemblies includes the drive gear being a dog gear having a recess therein which receives a dowel which extends from one end of the core, the dowel having extending therearound a dog gear, the teeth of which being in matable engagement with the driving dog gear on the arm.

The other embodiment of the gear assembly of the present invention includes a bevel gear rotatably mounted on the motor, the bevel gear in engagement with a spur gear which is on a shaft that is rotably mounted within the arm, the spur gear being in engagement with a transfer gear which is on another shaft that is rotably mounted within the arm. The driven gear assembly comprises a reducing gear which is on a shaft which projects from one end of the core, the teeth of the reducing gear being in meshing engagement with the teeth of the transfer gear. Actuation of the motor causes the bevel gear to rotate which allows the spur gear to rotate, thereby turning the transfer gear which causes the reducing gear on the core to also rotate. The core is thus caused to rotate and dispense the toilet tissue from the roll mounted on the core.

A primary object of the present invention is to provide a toilet tissue dispensing assembly which is adapted to be mounted over a pre-existing, wall mounted tissue holder.

Another object of the present invention is to provide a battery-operated toilet tissue dispensing assembly wherein the motor is located within a stationary housing.

DETAILED DESCRIPTION OF THE PREFERRED EMBODIMENTS

A. First Embodiment

Figure 1:
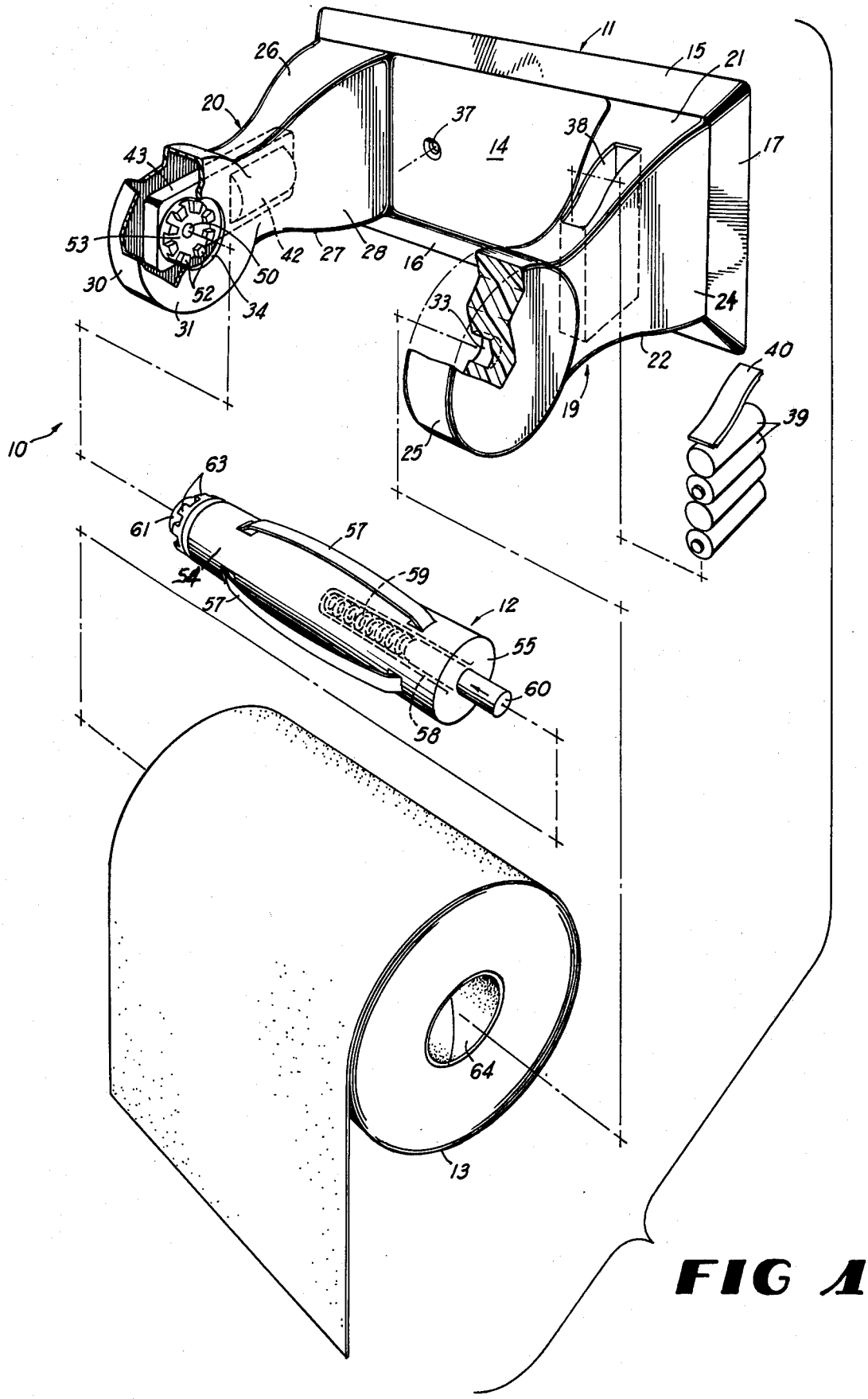
FIG. 1 is an exploded cut-away perspective view of the first embodiment of the present invention.

The first embodiment of the present invention is shown generally in FIG. 1 and is referred to by the numeral 10 and comprises a housing 11, a core 12 and a common roll of toilet tissue paper 13.

Figure 2:
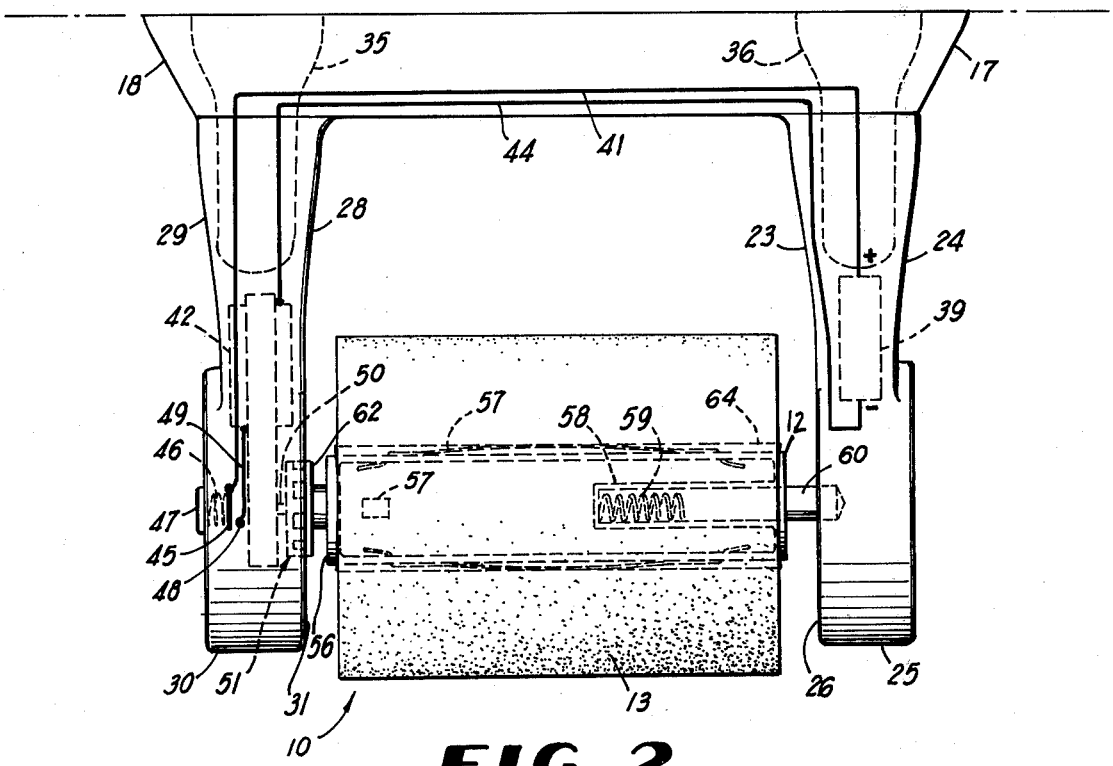
FIG. 2 is a top plan view of the first embodiment.

The housing 11, which can be constructed of any suitable material, such as plastic, comprises a rectangular frame 14 having outwardly inclined top and bottom elements 15 and 16 and side ends 17, 18. Mounting arms 19 and 20 laterally project from frame 14 adjacent the ends 17, 18 respectively. Each of the arms 19, 20 has the same overall outward appearance, arm 19 having curved top and bottom portions 21, 22 and sidewalls 23, 24 which terminate in circular portion 25 which has an inner face 26. The inner face 26 is a continuation of sidewall 23, as seen in FIG. 2. Arm 20 has top and bottom portions 26, 27 sidewalls 28, 29 which terminate in rounded portion 30 which has an inner face 31 which, is the continuation of sidewall 28. Rounded portion 30 has an outer face 32. An opening 33 is centrally provided through inner face 26 and extends partially through rounded portion 25, which is solid. An opening 34 is provided through innerface 31 to communicate with the hollow interior of rounded portion 30. The openings 33 and 34 are co-axial, with opening 34 being of a larger diameter than opening 33.

Arms 19, 20 are integrally formed with frame 14 to provide a hollow section within the arms 19, 20 which can be mounted over the brackets 35, 36 of an existing wall mounted ceramic toilet tissue dispenser, the brackets 35, 36 being shown in broken lines in FIG. 2.

A further means of mounting housing 11 to a vertical support includes it being screwed into the surface as shown in FIG. 1 by means of hole 37 through frame 14 adjacent arm 20, which can receive therein a suitable mounting screw; a similar hole (not shown) is provided adjacent arm 19.

An altenative mounting method include an adhesive being applied along the edges of top and bottom elements 15, 16 and side ends 17, 18 so that the housing 11 can adhere to a wall at a suitable location.

As shown in FIG. 1, a hollow, substantially rectangular chamber 38 is provided in arm 19 through top 21 to contain therein four pen-light batteries 39. A detachable top 40 is provided for snap-fitting engagement with the chamber 38 and conforms to the configuration of top 21.

Referring to FIG. 2, a wire extends from the positive terminal of battery chamber 38 through the rear of arm 19, behind frame 14 and into arm 20 to direct current motor 42. Motor 42 is mounted adjacent one end of rectangular housing 43 which extends into rounded portion 30. A wire 44 extends from the negative terminal of battery chamber 38 behind frame 14 and terminates at one end of plate 45 which is mounted at one end of spring 46 which is connected to button 47 that extends through outer wall 32 of round portion 30. Contact 48 is provided adjacent plate 45 and is connected to motor 42 through wire 49.

A shaft 50 projects from the side of housing 43 and is operatively connected to the motor 42 for rotation about its longitudinal axis. Secured on the free end of shaft 50 is a dog gear 51 having a plurality of outwardly projecting teeth 52 spaced about its outer periphery, the teeth 52 forming a recess 53.

Referring to FIG. 1, core 12 which can be constructed of any suitable material, such as wood or plastic, comprises a cylinder 54 having end walls 55 and 56. Leaf springs 57 are longitudinally spaced about the cylinder 54. Centrally disposed within cylinder 54 through end wall 55 is chamber 58 which contains spring 59 which is in abutting engagement about one of its ends with pin 60 which extends beyond end wall 55. Pin 60 is of sufficient dimension to be received for rotable engagement within opening 33.

Centrally projecting from end wall 56 is a shaft or dowel 61 which is in co-axial alignment with pin 60. The dowel 61 is permanently affixed to end 56. Positioned approximately mid-way along dowel 58 is dog gear 62 having teeth 63 which are capable of meshing engagement between teeth 52 on gear 51. Dowel 61 is of sufficient dimensions to be received with recess 53 on gear 51.

Roll 13 is of conventional size and construction, having an open ended inner cardboard cylinder 64 on which the tissue paper is wound to form the roll 13.

B. Operation of First Embodiment

The roll 13 is placed on core 12 by insertion of the core 12 through cardboard cylinder 58 until the ends 55, 56 of core 12 are adjacent the respective ends of roll 13, as shown in FIG. 2. The top of leaf springs 57 frictionally engage the inner surface of cylinder 64 so as to prevent the free rotation of roll 13 about the core 12. The free or distal end of pin 60 is inserted into opening 33 and the core 12 is then pushed in the direction of pin 60 such that the pin 60 is telescopically received within the chamber 58 against spring 59. The dowel 61 is brought into engagement with recess 53. The core 12 is rotated about pin 60 until the teeth 63 of gear 50 engage the respective spaces between the teeth 52 on gear 51. At that time, the core 12 is detachably secured within the housing 11 as shown in FIG. 2.

When it is desired to dispense a certain amount of tissue paper from roll 13, button 47 is pushed inwardly into rounded portion 30 whereby plate 45 engages the contact 48. That completes the electrical circuit from batteries 39 to motor 42 and causes operation of motor 42 to rotate shaft 50 and gear 51. The rotation of drive gear 51 causes the gear 62 to be driven, thereby causing core 12 to rotate about pin 60 within opening 33. Because of the frictional engagement of the interior of cylinder 64 by leaf springs 57, a rotation of core 12 causes a rotation of roll 13, as long as plate 45 is still in engagement with contact 48.

When a sufficient amount of tissue paper has been expended from roll 13, pressure on button 47 is relieved, allowing it to come to its normal position so that plate 45 disengages from contact 48 to break the electrical circuit from the batteries 39 to the motor 42. This causes the shaft 50 to stop rotating, which in turn causes the core 12 and, thus, roll 13 to also stop rotating. By this operation, a desired amount of tissue paper is effortlessly obtained.

C. Second embodiment

Figure 3:
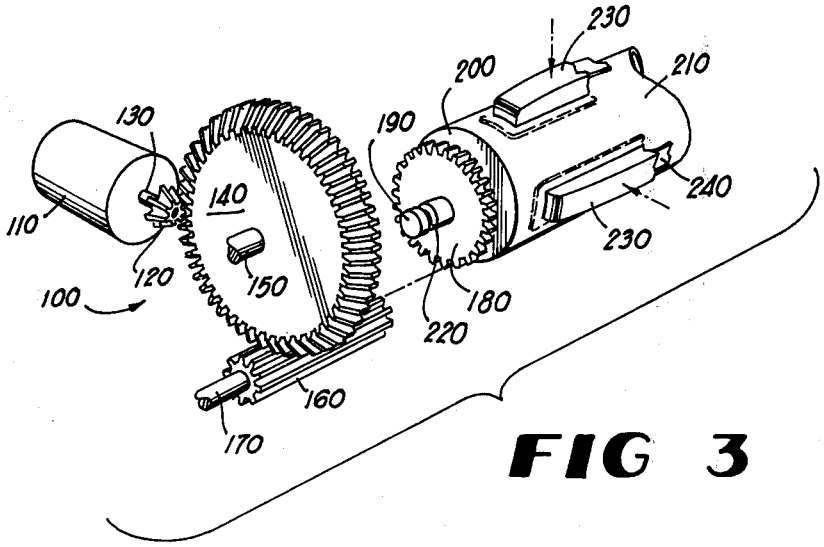
FIG. 3 is an exploded perspective view of a portion of the second embodiment of the present invention.

The second embodiment of the present invention is shown in FIG. 3 and is denoted generally by numeral 100. The motor 110 corresponds to the motor 42 of the first embodiment and is powered in the same manner as described above. A bevel gear pinion 120 is mounted on the end of shaft 130 which rotably projects from motor 110. A spur gear 140 is mounted on shaft 150 with the teeth of gear 140 in mating engagement with gear 120. Shaft 150 is rotatably mounted within a rounded portion similar to portion 30 and is in perpendicular alignment with shaft 130.

Disposed beneath gear 140 and in meshing engagement therewith is transfer gear 160 which is mounted at the end of shaft 170 is rotatably mounted in like manner as shaft 150 within a rounded portion similar to portion 30. The distal end of gear 160 extends beyond the inner face of the rounded portion 22 so as to engage the teeth of reducing gear 180 which is mounted along shaft 190 which projects outwardly from the end 200 of the core 210. A groove 220 is provided around shaft 190 adjacent its distal end to seat the core 210 for rotation within an opening provided in the rounded portion.

The core 210 is similar to core 12 described above, with the addition being flexible shoulders 230 secured to core 210 above leaf springs 240. The core 210 is provided with an assembly at its other end (not shown) similar to chamber 58, spring 59 and pin 60.

D. Operation of Second Embodiment

When the core 210 is inserted within the inner cardboard cylinder similar to cylinder 64 of a roll of tissue paper, the leaf springs 240 upwardly urge shoulders 230 into engagement along the longitudinal axis of the cylinder. A greater area of frictional engagement between the core 210 and the cardboard cylinder is obtained by the use of shoulders 230 than with the leaf springs 240 alone.

As with the first embodiment, pressure on a button on one of the arms completes an electrical circuit so as to allow motor 110 to operate, causing shaft 130 to rotate gear 120, which causes gear 140 to rotate about the axis of shaft 150. Rotation of gear 140 causes transfer gear 160 to rotate along the longitudinal axis of shaft 170. Core 210 is then caused to rotate about groove 220 by engagement of the teeth of gear 180 with the teeth of gear 160 to thereby dispense the requisite amount of tissue paper.

What I claim:

1. A toilet tissue dispensing assembly, comprising in combination:

a. a housing including a frame and a pair of mounting arms extending from said frame, a portion of one of said arms being hollow, b. drive means including a motor, drive gear means within one of said arms and connected to said motor and switch means on said housing to selectively actuate said motor; and c. a core rotatably mounted within said housing and in engagement with said drive gear means, said core being adapted to receive thereon a roll of toilet tissue whereby actuation of said switch means selectively rotates said roller to dispense an amount of tissue from said roll.

2. A toilet tissue dispensing assembly as claimed in claim 1 wherein said mounting arms are hollow and open rearwardly to receive therein the arm elements of a mounting bracket of a pre-existing dispenser, said core being horizontally supported between said arms for rotation about the longitudinal axis of said core.

3. A toilet tissue dispensing assembly as claimed in claim 2 wherein said core includes a pin longitudinally extending from one end of said core and a spring disposed within said core having one of its ends in engagement with the proximal end of said pin, one of said arms being provided with an opening for receiving said pin therein and said core being provided at its other end with driven gear means which engage said drive gear means.

4. A toilet tissue dispensing assembly as claimed in claim 3 wherein one of said arms is provided with a chamber for receiving therein batteries to power said motor.

5. A toilet tissue dispensing assembly as claimed in claim 4 wherein said drive gear means includes a shaft operatively connected for rotational movement to said motor, a first gear mounted on said shaft, said gear having spaced teeth outwardly projecting about its periphery and being further provided with a recessed portion centrally located on said gear and wherein said driven gear means includes a dowel longitudinally extending from the other end of said core and being of sufficient dimensions to be received within said recessed portion and a second gear disposed about said dowel said second gear having teeth thereon for interlocking engagement with said the spaces between said teeth on said first gear.

6. A toilet tissue dispensing assembly as claimed in claim 4 wherein said drive gear means includes a gear pinion on said motor, a spur gear in engagement with said pinion and a transfer gear in engagement with said spur gear and wherein said second gear means includes a reducing gear in engagement with said transfer gear.

7. A toilet tissue dispensing assembly comprising, in combination:

a. a housing inlcuding a rectangular frame and first and second mounting arms laterally projecting from a side of said frame adjacent opposite ends of said frame;

b. drive means at least partially within said second arm inlcuding a prime mover, a receiving element facing said first arm operatively connected to said prime mover and a switch for controlling said prime mover, said drive means rotating said receiving element about an axis extending toward said first arm when said switch is closed;

c. a cylindrical core having first means for receiving a roll of tissue paper thereabout and engaging the roll to prevent relative rotation between said cylindrical core and said roll, said cylindrical core further having second means at one end for being removably received in said receiving element for rotation therewith, said first arm and said cylindrical core being provided with third means by which the other end of said cylindrical core is rotatably supported by said first arm.

8. A toilet tissue dispensing apparatus as claimed in claim 7 wherein said third means includes spring means for urging said cylindrical core toward said second arm.

9. A toilet dispensing apparatus as claimed in claim 7 wherein said prime mover includes a motor in said second arm and said drive means further includes interconnecting means between said motor and said receiving element for rotating said receiving element when said switch activates said motor.

* * * * *